United States Patent [19]

Hubbard

[11] Patent Number: 4,506,344

[45] Date of Patent: Mar. 19, 1985

[54] HAND HELD ELECTRONIC POSTAGE METER HAVING SECURE POSTAGE METER DOORS

[75] Inventor: David W. Hubbard, Stamford, Conn.

[73] Assignee: Pitney Bowes Inc., Stamford, Conn.

[21] Appl. No.: 384,852

[22] Filed: Jun. 4, 1982

[51] Int. Cl.[3] ..... G07B 17/04

[52] U.S. Cl. ..... 364/900; 235/101; 364/708

[58] Field of Search ..... 364/900 MS File, 708; 194/DIG. 8; 235/101

[56] References Cited

U.S. PATENT DOCUMENTS

| | | | |
|---|---|---|---|
| Re. 31,441 | 11/1983 | Nutting et al. | 273/121 A |
| 1,013,116 | 1/1912 | Blum | 101/111 |
| 3,521,555 | 7/1970 | Price et al. | 101/103 |
| 3,524,406 | 8/1970 | Traynor | 235/101 X |
| 3,598,948 | 8/1971 | Bowen et al. | 200/159 R |
| 3,731,068 | 5/1973 | Hanson | 235/101 |
| 3,978,457 | 8/1976 | Check, Jr. et al. | 364/200 |
| 4,053,735 | 10/1977 | Foudos | 235/419 |
| 4,168,533 | 9/1979 | Schwartz | 364/900 |
| 4,178,847 | 12/1979 | Erhardt | 101/35 |
| 4,287,825 | 9/1981 | Eckert, Jr. et al. | 101/45 |
| 4,363,485 | 12/1982 | Edwall | 273/121 A |
| 4,372,694 | 2/1983 | Bovio et al. | 364/708 X |
| 4,471,441 | 9/1984 | Check, Jr. | 364/900 X |

*Primary Examiner*—Jerry Smith
*Assistant Examiner*—Clark A. Jablon
*Attorney, Agent, or Firm*—David E. Pitchenik; Albert W. Scribner; William D. Soltow, Jr.

[57] ABSTRACT

A pair of tamper proof postage meter doors which remain closed and locked until the proper combination of numbers is entered using the normal postage keyboard. The doors will not function if there is insufficient postage in the accounting registers. Means are also provided which will cause the ascending and descending registers in the postage meter to indicate zero postage remaining in the meter if an attempt is made to tamper with or force open the doors.

11 Claims, 5 Drawing Figures

HAND HELD ELECTRONIC POSTAGE METER HAVING SECURE POSTAGE METER DOORS

BACKGROUND OF THE INVENTION

The present invention relates to improving the integrity and security of postage meters and in particular, microcomputerized, miniature postage meters which may be held and operated by hand, are completely portable, and may be stored in any number of small spaces such as a pocket, purse or briefcase.

Postal meters are widely used by large and small businesses. The meters in use today are, in the main, mechanical devices in which postage values are set, printed and accounted for by means of mechanical assemblies such as linkages and registers. Such meters include a mechanical ascending register which provides a record of the amount of postage printed over the life of the meter and a mechanically descending register which provides a record of the amount of postage remaining for use in the meter. To prevent the tampering of such mechanical meters, a number of different mechanical interlocks have been used. Such interlocks prevent a user from printing postage amounts without changing the contents of the ascending and descending registers. Other interlocks and seals make it nearly impossible for the user, without leaving telltale signs, to reset the descending register without having the postage meter "recharged" by the post office.

Electronic postal meters have been developed as for example the meter shown in U.S. Pat. No. 3,978,457 (Check et al). In such meters, a computer device such as a microprocessor may account for postage and cause an electronically driven printer to be set to the proper postage amount. All data, including control accounting data, is stored in electrical format memory units. A postage meter construction has been proposed in U.S. Pat. No. 4,168,533 (Schwartz), assigned to the assignee of the present invention, which describes a self-contained, microcomputerized, miniature, portable, hand-held postage meter.

It has been recognized that the size and portability of these miniaturized postage meters will require increased security measures to protect the meter against improper use. Various arrangements have been developed for covering printing mechanisms which are described herein.

Covers or doors which afford protection for print heads have been designed. Examples are shown in U.S. Pat. No. 1,013,116 for Stamping Device, which includes protective cover members adapted to swing apart at a hinge when the stamp is to be used.

Other printing devices having swingable members automatically displaced in order to expose the printing indicia are shown in U.S. Pat. Nos. 3,521,555 (Price) and 3,598,948 (Hellstrom). The Price patent describes a marking device having stamp indicia carried on bands; an inking pad is swingably mounted on a shaft. The stamping apparatus in the Hellstrom patent discloses a printing type mounted on a slidable carriage for rectilinear movement within a frame toward or away from a print receiving surface. Levers support inking pad cups which are swung away from each other so that the printing type can be positioned in an opening for printing.

A portable postage meter having self-contained accounting registers is disclosed in U.S. Pat. No. 3,524,406 (Traynor). The device as illustrated has a printing assembly having a lower base and an outer housing adapted for telescopic movement with respect to the lower base. In operation, printing wheels pass through an opening in the lower base and will contact a printing surface. The amount of postage is recorded on registers. These registers are mechanically actuated through a gear train linkage. The extent of movement of the register settings is determined by the angular swing of a mechanical crank.

SUMMARY OF THE INVENTION

The present invention provides improved security particularly suitable for a hand held microcomputerized postage meter. After power is turned on, the doors on the postage meter will remain locked until the meter is properly used. For example, the meter can be caused to stay locked until the proper combination of numbers is entered using the accounting keyboard. This combination can be changed at the time the postage meter is recharged.

A postage meter system employing the present invention includes accounting means operatively coupled to a postage printing means. The accounting means accounts for postage printed by the printing means. Security is provided by a unique shielded housing. The housing includes a pair of movable housing elements which may be locked under various conditions. The movable housing elements can be moved under control of an actuating means to expose the postage printing means to print postage. In accordance with a feature of the invention, means may be provided which cooperates with the actuating means to prevent improper or extra unaccounted for postage impressions from being obtained.

Purchased postage is stored in a postage memory register, consisting of a non-volatile random access memory (RAM) incorporated in the microcomputer from which is subtracted the amount of postage printed during each meter use. The subtraction is under the control of the microprocessor and program memory. Prior to printing, the microprocessor compares the selected amount of postage with the amount of postage available in the memory register. If an insufficient amount of postage is in the register, the microprocessor does not provide a signal to activate the printing device. Thus, the postage meter is locked-out or disabled when the stored postage is depleted to a predetermined minimum amount. Accordingly, the meter becomes inoperable when the postage stored in it has been essentially exhausted. This standard "lock out" postage meter feature has been incorporated in the present invention. Means are provided which will initialize the lock-out feature if an attempt is made to improperly obtain postage. For example, the lock-out can be triggered if an attempt is made to "wipe off" a stamp without operating the doors. Each impression will be recorded on the accounting registers after one complete cycle of opening and closing of the clam shell doors.

DESCRIPTION OF THE DRAWINGS

While the specification concludes with claims particularly pointing out and distinctly claiming that which is regarded as the present invention, further details of preferred embodiments of the invention may be more readily ascertained from the following detailed description when read in conjunction with the accompanying drawings wherein:

DETAILED DESCRIPTION

Figure 1:
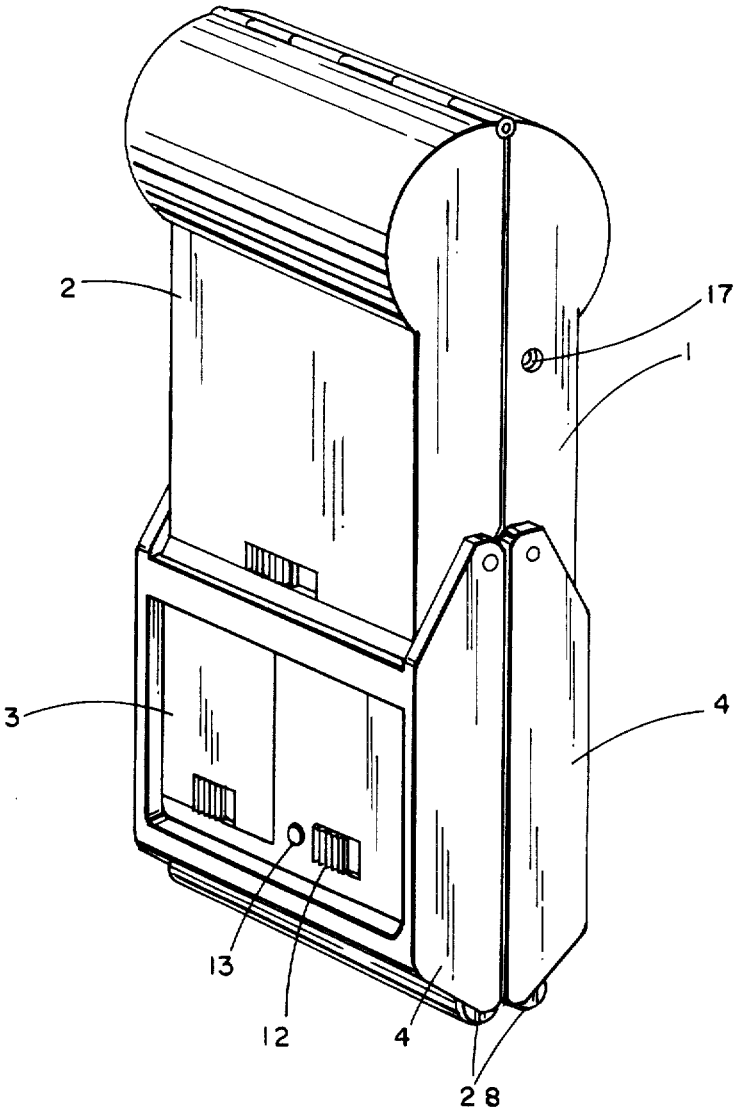
FIG. 1 is a perspective view of one embodiment hand held postage meter with all doors closed.
Figure 2:
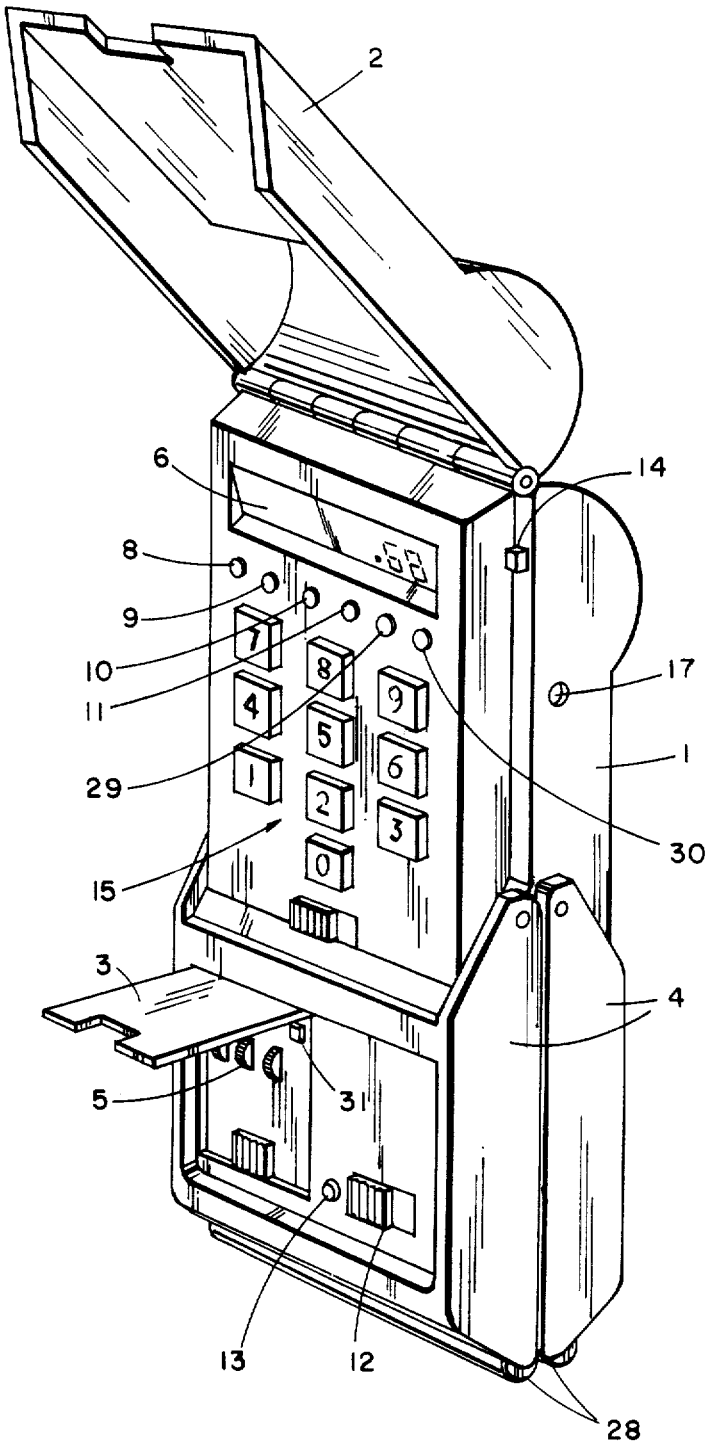
FIG. 2 is a perspective view showing all controls and displays with non-secure doors in the open position.
Figure 3:
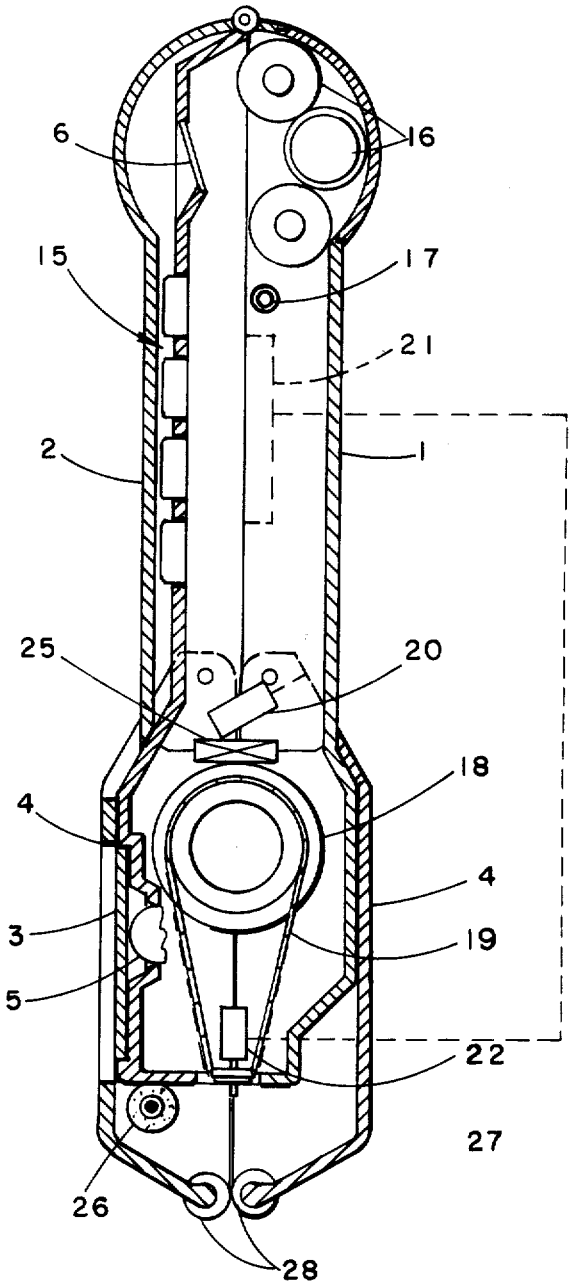
FIG. 3 is a perspective view of the postage applicator with portions of the housing and side walls cut away for purposes of illustrating the invention.

Referring to FIGS. 1 and 3, one embodiment of a hand held postage applicator which includes a electromagnetic radiation resisting base 1 which supports a generally pocket calculator-shaped printing device. Attached to the base are a cover 2 for a conventional keyboard 15 and display 6 and a cover 3 for thumbwheels 5 which are used to set the date in the permanent printing indicia 27 which also includes the meter serial number. Next to the date thumbwheels 5 is a conventional on-off switch 12 and a power on light 13. Between the keyboard 15 and display 6 are enter combination 8, check date 9, low postage 10, charge battery 11, enter postage 29 and enter pieces 30 indicator lamps.

In the gap between the keyboard cover 2 and the base 1 is a microswitch 14 which will inhibit the clam shell doors 4 from operating until the keyboard cover 2 is closed.

FIG. 3 shows the doors 4 in the closed position. The anti-wipe switch 22 functions as both a piece or impression counter. The door solenoid is de-energized when the doors are locked. The solenoid is energized as a result of the microprocessor 21 receiving the correct sequence of instructions from the keyboard 15. In the event of the anti-wipe switch being engaged without the proper signal being present at the door solenoids 20, the postage in the descending register which is part of the microprocessor will be set to zero and a code which resides in the non-volatile memory portion of the microprocessor 21 will appear on the display 6 indicating that the postage meter has been tampered with.

The inking roll 26 is made of an ink impregnated foam which does not require an ink reservoir. The inking roll 26 is linked with the spring 25 loaded mechanism which restores the secure doors 4 to the closed, locked position after each print cycle.

The self contained batteries 16 serve as a power supply. The meter could also function without batteries 16 or low charged batteries when the battery charger is plugged into the charger socket 17.

A plurality of print bands 19 are indexed by the denomination setting stepping motor. The locations of the bands 19 are checked by the microprocessor 21.

Figure 4:
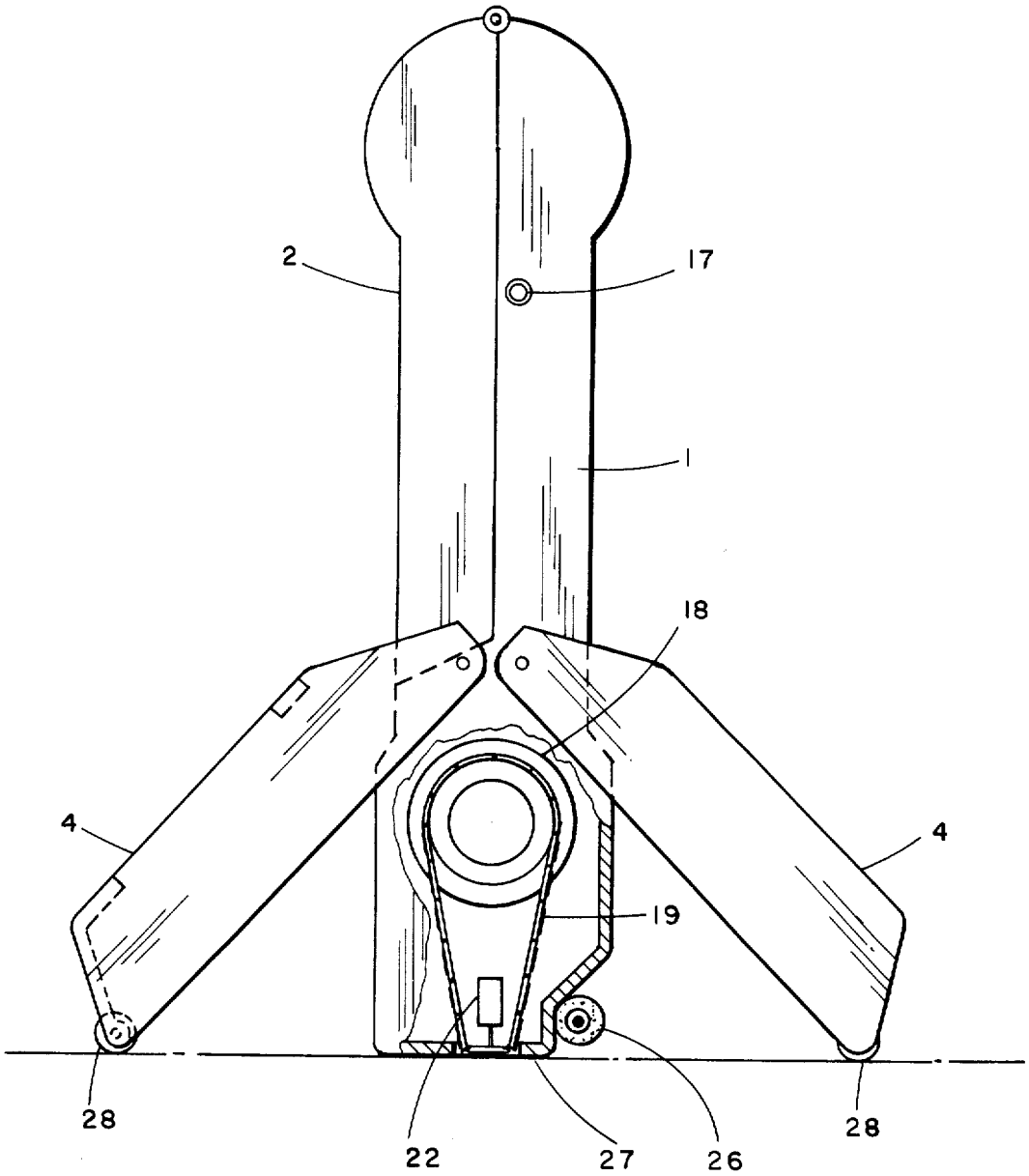
FIG. 4 is a side view which illustrates the meter in the secure and print position.
Figure 5:
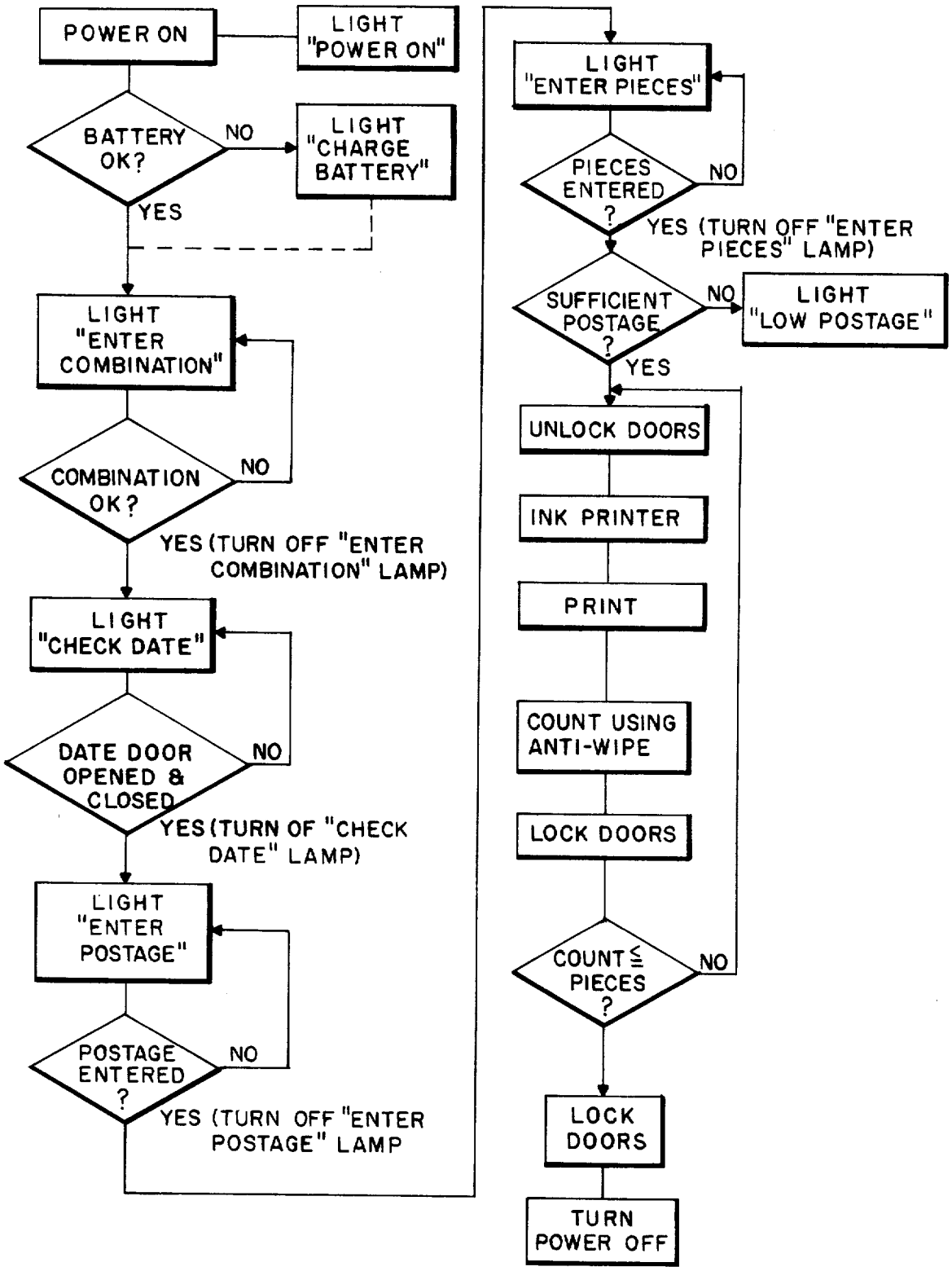
FIG. 5 is a flow chart of one program for the electrical system.

Referring now to the flow chart FIG. 4. The normal operation of the secure postage meter doors is as follows:

The power switch 12 is turned on and the power on lamp 13 lights. If the battery 16 voltage is below a predetermined critical level, the charge battery lamp 11 will light, the doors 4 will remain closed and no further operations will take place. The charge battery lamp 11 will remain lit until the proper charger and voltage are applied to the battery charger socket 17. As soon as the proper voltage is detected, the enter combination lamps 8 will light. The predetermined numeral combination is entered via the keyboard 15 and verified by the microprocessor 21. If the proper combination is not entered, the doors 4 will remain closed, the enter combination lamp will remain lit and all other operations will cease.

After receiving the proper combination, the enter combination lamp 8 goes off and the check date lamp 9 turns on. The microprocessor 21 must detect a change in voltage level caused by the date set switch 31 being activated by the date set door 3 being opened and closed. It is not necessary to change the date using the date set thumbwheels 5, the opening and closing of the date set door 3 causes the check date lamp 9 to turn off and the enter postage lamp 29 to light. The enter postage lamp 29 remains on until the amount to be stamped is entered on the keyboard 15. When the postage is entered, the denomination setting stepper motor 18 indexes the print bands 19 and the position is verified by the microprocessor. The enter postage lamp 29 then goes off and the enter piece lamp 30 turns on.

The number of pieces to be stamped is entered using the keyboard 15. The microprocessor 21 calculates the postage times the amount of pieces and compares the total with the postage remaining in the descending register portion of the microprocessor 21. When there is less than sufficient funds remaining in the meter, the low postage lamp 10 will light, the doors will remain locked and all operations cease. When the amount of postage remaining is equal or greater than the calculated product of the postage and piece count, the door solenoid 20 becomes energized on a signal from the microprocessor 21. The doors 4 open as the upper housing is manually pushed down for this hand stamping operation. The inker 26 rolls across the print indicia. The anti-wipe switch 22 is depressed and released after printing.

Power is removed from the door solenoid 20. The count number is compared by the microprocessor 21. The microprocessor 21 will continue to send signals to energize the door solenoid 20 until the count is equal to the piece count entered.

What is claimed is:

1. In a postage meter of the type having means for printing postage and accounting means operatively coupled to the postage printing means for accounting for postage printed by said printing means, the improvement comprising:

a secure housing for enclosing said postage printing means and said accounting means, said secure housing having first and second housing members movable in between a first position wherein said postage printing means is exposed and a second position where said postage printing means is enclosed;

actuating means coupled to said housing first member and said housing second member, said actuating means operable to move said housing first and second members between first position where said printing means is exposed and said second position where said printing means is enclosed;

said actuating means having a locking means for preventing said actuating means from being operable to move said housing first and second members from said second position where said printing means is enclosed to said first position where said printing means is exposed unless the postage funds available for printing in said accounting means is at least equal to the amount of postage to be printed by said printing means; and tamper detecting means coupled to said accounting means for canceling remaining postage in said postage meter if an attempt is made to force open said secure housing.

2. A postage meter as defined in claim 1 where said first and said second housing members are clam shell doors.

3. A postage meter as defined in claim 1 where said actuating means is caused to operate by pressing said housing first and second members against a mail piece with sufficient force to cause said mechanism to operate.

4. A postage meter as defined in claim 3 wherein said housing first and second members have an axial dimension and said actuating means operates when moved along said axial dimension in the direction of said mail piece.

5. A postage meter as defined in claim 1 wherein said postage meter is a hand held meter and said accounting means includes an microprocessor circuit means.

6. A postage meter as defined in claim 1 wherein said secure housing includes a secure section operatively connected to said first and said second housing members to form a continuous housing protecting said accounting means against electromagnetic radiation.

7. A postage meter as defined in claim 6 having data entry means for entering data into said meter to set said printing means to a desired postage value to be printed.

8. A postage meter as defined in claim 7 wherein said data entry means is a keyboard.

9. A postage meter as defined in claim 8 including display means operatively connected to said accounting means.

10. In a hand held postage meter of the type having means for printing postage and accounting means operatively coupled to the postage printing means for accounting for postage printed by said printing means, the improvement comprising:

a secure housing for enclosing said postage printing means and said accounting means, said secure housing having first and second cooperating clam shell type doors movable in between a first position where said postage printing means is exposed and a second position where said postage printing means is enclosed;

actuating means coupled to said housing first clam shell door and said housing second clam shell door, said actuating means operable to move said housing first and second clam shell doors between said first position where said printing means is exposed and said second position where said printing means is enclosed;

said actuating means having a locking means for preventing said actuating means from being operable to move said first and second clam shell doors from said second position where said printing means is enclosed to said first position where said printing means is exposed unless the postage funds available for printing in said accounting means is at least equal to the amount of postage to be printed by said printing means;

a keyboard for entering data into said meter mounted on said secure housing;

a display mounted on said secure housing operatively connected to said keyboard and said accounting means for displaying data; and tamper detecting means coupled to said accounting means for canceling remaining postage in said postage meter if an attempt is made to force open said secure housing.

11. A postage meter as defined in claim 10 further including a dust cover mounted to said secure housing for covering said keyboard and said display.

* * * * *